United States Patent [19]

Caskey

[11] Patent Number: 4,921,046

[45] Date of Patent: May 1, 1990

[54] HORIZONTAL HOLE CLEANUP TOOL

[75] Inventor: Kenneth D. Caskey, Duncan, Okla.

[73] Assignee: Halliburton Company, Duncan, Okla.

[21] Appl. No.: 283,638

[22] Filed: Dec. 13, 1988

[51] Int. Cl.[5] ..... E21B 37/02

[52] U.S. Cl. ..... 166/170; 166/173; 166/185; 166/202; 166/312; 15/104.05; 15/104.16

[58] Field of Search ..... 166/170, 173, 177, 202, 166/185, 223, 312; 15/104.05, 104.06, 104.09, 104.1 R, 104.16

[56] References Cited

U.S. PATENT DOCUMENTS

| | | | |
|---|---|---|---|
| 2,512,801 | 6/1950 | Kimmey et al. | 166/312 |
| 2,935,132 | 5/1960 | Arterbury et al. | 166/170 |
| 3,251,416 | 5/1966 | Kiel | 166/312 |
| 3,648,777 | 3/1972 | Arterbury et al. | 166/312 |
| 3,760,878 | 9/1973 | Peevey | 166/185 |
| 4,027,732 | 6/1977 | Perkins | 166/312 |
| 4,421,182 | 12/1983 | Moody et al. | 175/65 |
| 4,431,058 | 2/1984 | Spencer et al. | 166/312 |
| 4,505,341 | 3/1985 | Moody et al. | 175/65 |
| 4,625,799 | 12/1986 | McCormick et al. | 166/223 |
| 4,705,107 | 11/1987 | Council et al. | 166/170 |
| 4,744,420 | 5/1988 | Patterson et al. | 166/312 |
| 4,781,250 | 11/1988 | McCormick et al. | 166/240 |

OTHER PUBLICATIONS

Otis HYDRA-BLAST SERVICES Brochure, 1988.

*Primary Examiner*—Bruce M. Kisliuk
*Attorney, Agent, or Firm*—James R. Duzan

[57] ABSTRACT

A well clean-out tool comprising a ported nipple, thimble, packer cup, packer cup mandrel and an inner mandrel.

2 Claims, 1 Drawing Sheet

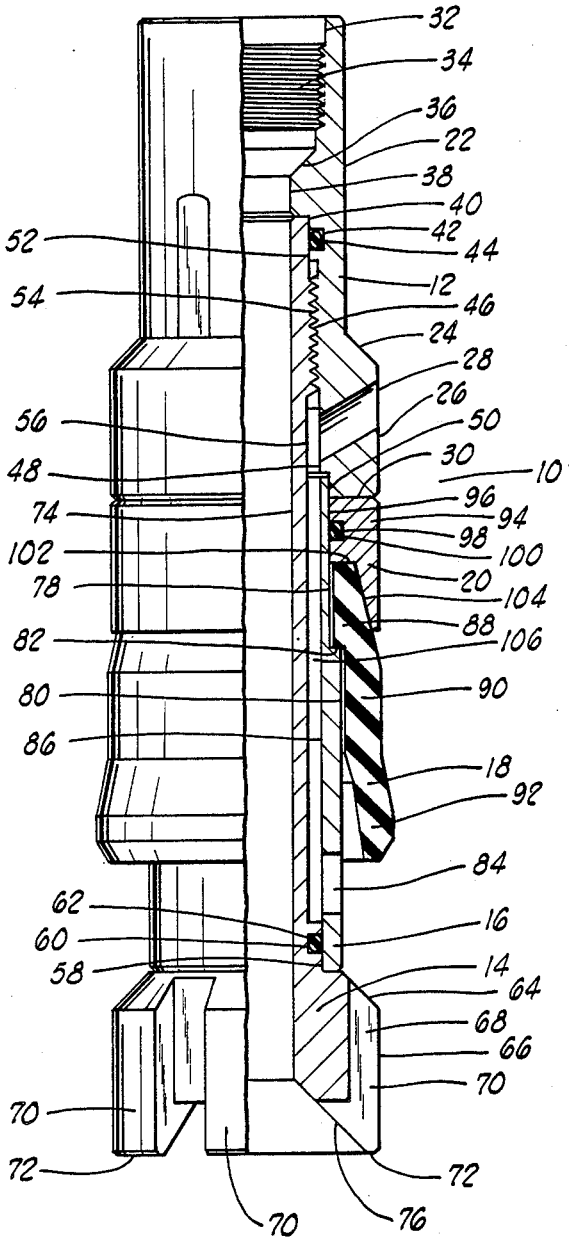
32
34
36
22
38
40
42
44
12
46
24
28
26
50
30
10
96
94
98
100
20
104
88
106
90
18
92
84
16
14
64
68
66
70
72
76
52
54
56
48
74
102
78
82
80
86
62
60
58
70
72
70

HORIZONTAL HOLE CLEANUP TOOL

BACKGROUND OF THE INVENTION

This invention relates to a well clean-out tool. More specifically, this invention relates to a well clean-out tool for use in cleaning out highly-deviated or horizontal wells.

Various types of well clean-out tools are well known in the art. One type, a bailer type tool, is shown in U.S. Pat. Nos. 4,421,182 and 4,505,341. Another type, a jetting type tool, is shown in U.S. Pat. Nos. 4,625,799, 4,705,107 and 4,781,250.

While the bailer type tool is useful in cleaning out loose debris in vertical portions of wells, it is difficult to use effectively in the highly deviated portions of wells or the horizontal portions of wells.

Similarly, while the jetting type tools are useful in cleaning out production deposits in producing wells, in some instances the fluid flow rates through the tools may not be great enough to keep the jetted debris in suspension in the fluid in the annulus between the casing and pipe string until the fluid reaches the surface of the earth.

STATEMENT OF THE INVENTION

The present invention relates to a well clean-out tool. More specifically, the invention relates to a well clean-out tool for use in cleaning out highly-deviated or horizontal wells. The well clean-out tool of the present invention comprises a ported nipple, thimble, packer cup, a packer cup mandrel and an inner mandrel.

DESCRIPTION OF THE DRAWINGS

The Figure is a quarter-sectional view of the well clean-out tool of the present invention.

The well clean-out tool of the present invention will be better understood taking the drawing in conjunction with the detailed description of the invention hereafter.

DETAILED DESCRIPTION OF THE INVENTION

Referring to the Figure, the well clean-out tool 10 of the present invention is shown. The well clean-out tool 10 of the present invention comprises a ported nipple 12, inner 5 mandrel 14, packer cup mandrel 16, packer cup 18 and thimble 20.

The ported nipple 12 comprises an annular cylindrical member having, on the exterior thereof, first cylindrical surface 22, frusto-conical annular surface 24, and second cylindrical surface 26 having, in turn, a plurality of fluid ports 28 therethrough to the interior of the cylindrical member, end surface 30, and, on the interior thereof, first bore 32, first threaded bore 34, frusto-conical annular surface 36, second bore 38, third bore 40 having, in turn, annular recess 42 therein containing annular elastomeric seal 44 therein, second threaded bore 46, fourth bore 48 having, in turn, a plurality of ports 28 thereinto, and fifth bore 50.

The inner mandrel 14 comprises an annular elongated cylindrical member having, on the exterior thereof, first cylindrical surface 52 which sealingly engages annular elastomeric seal 44 and is slidingly received within the fifth bore 50 of ported nipple 12, threaded surface 54, second cylindrical surface 56, third cylindrical surface 58 having, in turn, annular recess 60 therein containing annular elastomeric seal 62 therein, frusto-conical annular surface 64, fourth cylindrical surface 66 and a plurality of longitudinal slots 68 formed in surfaces 64 and 66 to form a plurality of teeth 70 on the end 72 of inner mandrel 14 and, on the interior thereof, bore 74 and frusto-conical annular surface 76. The longitudinal slots 68 also serve as fluid flow passages during operation of the clean-out tool 10.

The packer cup mandrel 16 comprises an annular elongated cylindrical member having, on the exterior thereof, first cylindrical surface 78 and second cylindrical surface 80 having, in turn, annular shoulder 82 formed between surfaces 78 and 80 a plurality of fluid ports 84 therein to the interior of the mandrel 16 and on the interior thereon, bore 86 which sealingly engages annular elastomeric seal 62 of inner mandrel 14 having, in turn, the plurality of fluid ports 84 therein.

The packer cup 18 comprises an annular elastomeric member having an attachment portion 88 which is retained on packer cup mandrel 16, intermediate portion 90 and sealing portion 92 which slidingly sealingly engages the casing or liner in the wellbore in which the clean-out tool 10 is run. The packer cup 18 may be formed of any suitable type elastomeric material and may contain suitable reinforcing materials therein.

The thimble 20 comprises an annular cylindrical member 20 having, on the exterior thereof, cylindrical surface 94 and, on the interior thereof, bore 96 having, in turn, annular recess 98 therein containing annular seal 100 therein, annular shoulder 102 and frusto-conical annular surface 104. The thimble 20 retains packer cup 18 on packer cup mandrel 16 in abutment with annular shoulder 82 of mandrel 16.

OPERATION OF THE INVENTION

Still referring to FIG. 1, the operation of the well clean-out tool 10 of the present invention is as follows.

The well clean-out tool 10 is connected to a suitable pipe string (not shown) via ported nipple 12 and run into the well bore to the desired location therein. At that time, fluid is pumped down the annulus between the pipe string and casing in the well bore and flows into the clean out tool 10 through the plurality of fluid ports 28 in ported nipple 12. The fluid flows through annulus 106 formed between the inner mandrel 14 and ported nipple 12 and packer cup mandrel 16 of the clean-out tool 10, out the plurality of ports 84 in the packer cup mandrel 16, and through the plurality of slots 68 in inner mandrel 14 past the teeth 72 on the bottom 70 of the mandrel 14 to wash loose debris in the casing in the well bore up through the bore 74 of inner mandrel 14 and bore 38 of ported nipple 12 into the pipe string connected to the clean-out tool 10 to the top of the well bore at the surface of the earth.

Fluid is prevented from flowing past the well clean-out tool 10, in either direction, by the packer cup 18 sealingly engaging the casing in the well bore.

If desired, the well clean-out tool 10 may be rotated during the fluid clean out operations by rotating the pipe string so that the teeth 72 on the bottom 72 of inner mandrel 14 loosens debris in the casing to facilitate the fluid washing the debris out the casing up through the tool 10.

It will be obvious to those of ordinary skill in the art that numerous changes or modifications can be made to the well clean-out tool 10 of the present invention which are intended to be within the scope of the invention. For instance, the ported nipple 12 and thimble 20 could be formed as an integral piece; the annular seal 62 could be moved from the exterior of the inner mandrel 14 to the interior of the packer cup mandrel 16; the annular seal 102 could be moved from the interior of the thimble 20 to the exterior of the packer cup mandrel 16; or more than one packer cup 18 could be used on the well clean-out tool 10.

Having thus described my invention, I claim:

1. A well clean-out tool secured to a conduit string located in a well bore having casing therein, said well clean-out tool and said conduit string forming an annulus with respect to said casing in said well bore for fluid to be pumped thereinto, said casing having debris therein, said well clean-out tool comprising:

an inner mandrel having annular seal means thereon, a plurality of teeth formed on one end thereof by a plurality of longitudinal slots being formed in a frusto-conical annular surface and a cylindrical surface on the one end of the inner mandrel, and a bore therethrough;

a ported nipple having a portion thereof secured to the other end of the inner mandrel, another portion thereof secured to said conduit string located in said well bore having said casing therein, a plurality of fluid ports therethrough, and a bore therethrough;

an annular packer cup mandrel having one end thereof received within the ported nipple, a portion thereof overlying a portion of the inner mandrel forming an annulus between the exterior of the inner mandrel and the interior of the packer cup mandrel, a portion thereof sealingly engaging the annular seal means on the inner mandrel, and a plurality of fluid ports therethrough;

an elastomeric packer cup retained on a portion of the packer mandrel, the elastomeric packer cup slidingly engaging a portion of said casing in said well bore to separate said casing in said well bore into an upper portion and a lower portion; and an annular thimble retained on the packer cup mandrel having a portion thereof abutting the packer cup and having an annular seal means therein sealingly engaging a portion of the packer cup mandrel, whereby when fluid is pumped into said annulus between said well clean-out tool secured to said conduit string and said casing, the fluid flows through the upper portion of said annulus above the elastomeric packer cup, through the plurality of fluid ports in the ported nipple, through the annulus between the exterior of the inner mandrel and the interior of the packer cup mandrel, out through the plurality of fluid ports in the annulus packer cup mandrel into the lower portion of said annulus below the elastomeric packer cup, through the plurality of longitudinal slots formed on one end of the inner mandrel, and into the bore of the inner mandrel, into the bore of the ported nipple and into said conduit string to thereby wash sand debris from said casing in said well bore into said well clean-out tool and said conduit string and whereby when said well clean-out tool is reciprocated and/or rotated in said casing in said well bore while the elastomeric packer cup remains in sliding sealing engagement with said casing, the plurality of teeth on one end of the inner mandrel loosens said debris in said casing to facilitate said fluid in washing said debris from said casing through said well clean-out tool and into said conduit string.

2. The well clean out tool of claim 1 wherein the inner mandrel is releasably secured to the ported nipple.

* * * * *

UNITED STATES PATENT AND TRADEMARK OFFICE

CERTIFICATE OF CORRECTION

PATENT NO. : 4,921,046

DATED : May 1, 1990

INVENTOR(S) : Kenneth D. Caskey

It is certified that error appears in the above-indentified patent and that said Letters Patent is hereby corrected as shown below:

Column 3, line 35, insert the word --cup-- after the word packer (first occurrence).

Signed and Sealed this

Fourteenth Day of June, 1994

Bruce Lehman

*Attest:*

BRUCE LEHMAN

*Attesting Officer*

*Commissioner of Patents and Trademarks*